US009593596B2

(12) United States Patent
Uskert et al.

(10) Patent No.: US 9,593,596 B2
(45) Date of Patent: Mar. 14, 2017

(54) COMPLIANT INTERMEDIATE COMPONENT OF A GAS TURBINE ENGINE

(71) Applicant: Rolls-Royce Corporation, Indianapolis, IN (US)

(72) Inventors: Richard C. Uskert, Timonium, MD (US); David J. Thomas, Brownsburg, IN (US); Adam L. Chamberlain, Mooresville, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 707 days.

(21) Appl. No.: 14/142,754

(22) Filed: Dec. 28, 2013

(65) Prior Publication Data

US 2015/0016956 A1 Jan. 15, 2015

Related U.S. Application Data

(60) Provisional application No. 61/776,750, filed on Mar. 11, 2013.

(51) Int. Cl.
*F01D 25/26* (2006.01)
*F01D 5/28* (2006.01)
(Continued)

(52) U.S. Cl.
CPC ..... *F01D 25/26* (2013.01); *F01D 5/284* (2013.01); *F01D 5/3007* (2013.01); *F01D 5/323* (2013.01); *F01D 11/006* (2013.01); *F01D 25/14* (2013.01); *F01D 25/28* (2013.01); *F04D 29/023* (2013.01); *F04D 29/322* (2013.01); *F05D 2260/941* (2013.01); *F05D 2300/6032* (2013.01); *F05D 2300/6033* (2013.01); *Y10T 29/4932* (2015.01)

(58) Field of Classification Search
CPC ..... F01D 5/3092; F01D 5/284; F01D 5/3007; F01D 5/323; F01D 25/26; F01D 25/14; F01D 25/28; F01D 11/006
USPC ..... 416/224, 204 A, 215, 216, 217, 218, 416/219 R, 220 R, 221, 220 A, 219 A, 416/204 R
See application file for complete search history.

(56) References Cited

U.S. PATENT DOCUMENTS 2,667,327 A * 1/1954 Hardigg ..... F01D 5/323 29/513
3,045,329 A * 7/1962 Carli ..... F01D 5/323 29/513
(Continued)

FOREIGN PATENT DOCUMENTS

DE 2639200 A1 3/1978
EP 2511480 A2 10/2012
(Continued)

OTHER PUBLICATIONS

International Search Report and Written Opinion, International Application No. PCT/US2013/078139, Oct. 21, 2014, 12 pages.

*Primary Examiner* — Richard Edgar
(74) *Attorney, Agent, or Firm* — Barnes & Thornburg LLP

(57) ABSTRACT

One aspect of present application provides an intermediate structure in a gas turbine engine. The intermediate structure is positioned between a first component and another component. The first component may be a composite component. The components may be interlocking. The intermediate structure may be load bearing. Also disclosed is a method using the intermediate structure.

18 Claims, 5 Drawing Sheets

(51) Int. Cl.

| | |
|---|---|
| ***F01D 5/30*** | (2006.01) |
| ***F01D 5/32*** | (2006.01) |
| ***F01D 11/00*** | (2006.01) |
| ***F01D 25/14*** | (2006.01) |
| ***F01D 25/28*** | (2006.01) |
| *F04D 29/32* | (2006.01) |
| *F04D 29/02* | (2006.01) |

(56) References Cited

U.S. PATENT DOCUMENTS

| | | | |
|---|---|---|---|
| 3,858,290 | A | 1/1975 | Albani et al. |
| 4,087,199 | A | 5/1978 | Hemsworth et al. |
| 5,630,700 | A | 5/1997 | Olsen et al. |
| 5,820,337 | A | 10/1998 | Jackson et al. |
| 6,514,046 | B1 | 2/2003 | Morrison et al. |
| 6,610,385 | B2 | 8/2003 | Cairo |
| 6,652,228 | B2 | 11/2003 | Tiemann |
| 7,083,388 | B2 | 8/2006 | Parisi et al. |
| 7,247,002 | B2 | 7/2007 | Albrecht et al. |
| 7,247,022 | B2 | 7/2007 | Allred et al. |
| 7,278,820 | B2 | 10/2007 | Keller |
| 7,410,342 | B2 | 8/2008 | Matheny |
| 7,494,317 | B2 | 2/2009 | Keller et al. |
| 7,526,862 | B2 | 5/2009 | Leveque et al. |
| 7,600,978 | B2 | 10/2009 | Vance et al. |
| 7,670,116 | B1 | 3/2010 | Wilson, Jr. et al. |
| 7,824,150 | B1 | 11/2010 | Kimmel et al. |
| 7,950,234 | B2 | 5/2011 | Radonovich et al. |
| 8,061,977 | B2 | 11/2011 | Keller et al. |
| 8,562,294 | B2 * | 10/2013 | Gouda ..... F01D 5/081 415/110 |
| 9,062,553 | B2 * | 6/2015 | Baumas ..... F01D 9/042 |
| 2003/0031555 | A1 | 2/2003 | Noe et al. |
| 2006/0034679 | A1 | 2/2006 | Harding et al. |
| 2009/0232644 | A1 | 9/2009 | Greene et al. |
| 2010/0021290 | A1 | 1/2010 | Schaff et al. |
| 2010/0080707 | A1 | 4/2010 | Tholen |
| 2010/0166565 | A1 | 7/2010 | Uskert et al. |
| 2011/0293410 | A1 | 12/2011 | Marusko et al. |
| 2012/0156029 | A1 | 6/2012 | Karafillis et al. |
| 2014/0234117 | A1 * | 8/2014 | Cairo ..... F01D 5/3084 416/241 R |

FOREIGN PATENT DOCUMENTS

| | | | |
|---|---|---|---|
| FR | 2951494 | A1 | 4/2011 |
| GB | 836030 | A | 6/1960 |

* cited by examiner

COMPLIANT INTERMEDIATE COMPONENT OF A GAS TURBINE ENGINE

CROSS REFERENCE TO RELATED APPLICATIONS

This application claims priority to and the benefit of U.S. Provisional Patent Application No. 61/776,750, filed 11 Mar. 2013, the disclosure of which is now expressly incorporated herein by reference.

GOVERNMENT RIGHTS

The present application was made with United States government support under Contract No. DTFAWA-10-C-00006, awarded by the Department of Transportation. The United States government may have certain rights in the present application.

TECHNICAL FIELD

The present disclosure generally relates to gas turbine engine component interconnections. More particularly, but not exclusively, the present disclosure relates to an intermediate structure disposed between components in which at least one component is a composite structure including ceramic matrix composite (CMC) material.

BACKGROUND

Providing load bearing transfer, abrasion resistance, and/or other features between gas turbine engine components having dissimilar materials, shapes, etc. remains an area of interest. Some existing systems have various shortcomings relative to certain applications. Accordingly, there remains a need for further contributions in this area of technology.

SUMMARY

One embodiment of the present invention is a unique intermediate structure in a gas turbine engine positioned between a composite component and another component. Other embodiments include apparatuses, systems, devices, hardware, methods, and combinations for intermediate structures used with a CMC component of an engine construction. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
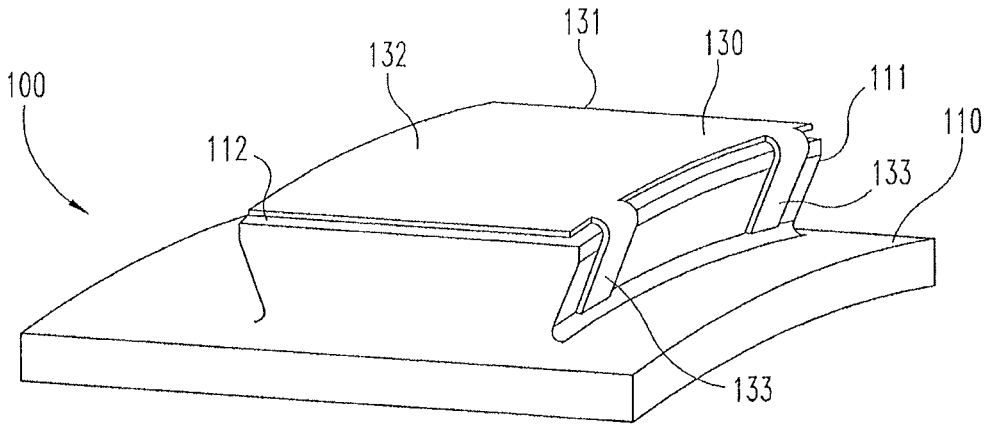
FIG. 1 is a perspective view of an embodiment of a component interfacing with an intermediate component.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, an illustrative embodiment of a portion of a gas turbine engine 100 is shown including a first gas turbine engine component 110 and a load bearing intermediate component 130 that is positioned between the component 110 and another component to which component 110 is coupled. The gas turbine engine component 110 can represent a variety of structures within a gas turbine engine including, but not limited to, pivoting or static vanes, blade tracks, and rotating airfoils such as blades.

First gas turbine engine component 110 is shown with a first mating portion 111 which can take on various geometries in other embodiments. In one embodiment, the first mating portion 111 can include part of an interlocking feature capable of fastening the first mating portion 111 with the other structure, non-limiting examples of which are shown further below. First mating portion 111 includes a surface 112 which can have various profiles including but not limited to an arcuate shape, a substantially planar surface, a textured surface, and combinations thereof among other possibilities. The first gas turbine engine component 110 can be a composite structure, and in one non-limiting form is made with a ceramic matrix composite (CMC). As will be appreciated, the first gas turbine engine component 110 will have a first coefficient of thermal expansion associated with it which can be different than the coefficient of thermal expansion associated with other structures used within the gas turbine engine and that also are coupled to the first gas turbine engine component 110.

The load bearing intermediate component 130 is positioned relative to first mating portion 111 of first gas turbine engine component 110 and is depicted as including a main body 131, a top portion 132, and a plurality of finger portions 133. The load bearing intermediate component 130 is configured to bear a load from contact between first gas turbine engine component 110 and a second gas turbine engine component (not shown) and in that way any of the number of portions (main body 131, top portion 132, finger portions 133, etc.) of the load bearing intermediate component can be configured to bear the load. The intermediate component 130 can be structured to be consumable due to abrasion as it is loaded as a result of operation and/or repeated operations of the gas turbine engine.

Figure 2A:
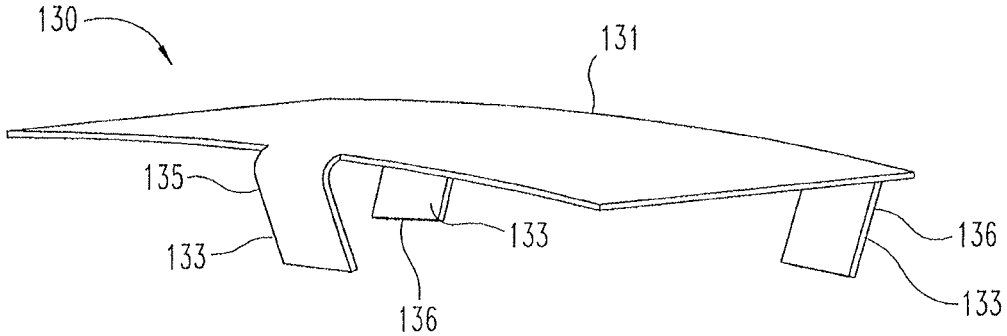
FIG. 2A is a perspective view of an embodiment of an intermediate component of the present application.
Figure 2B:
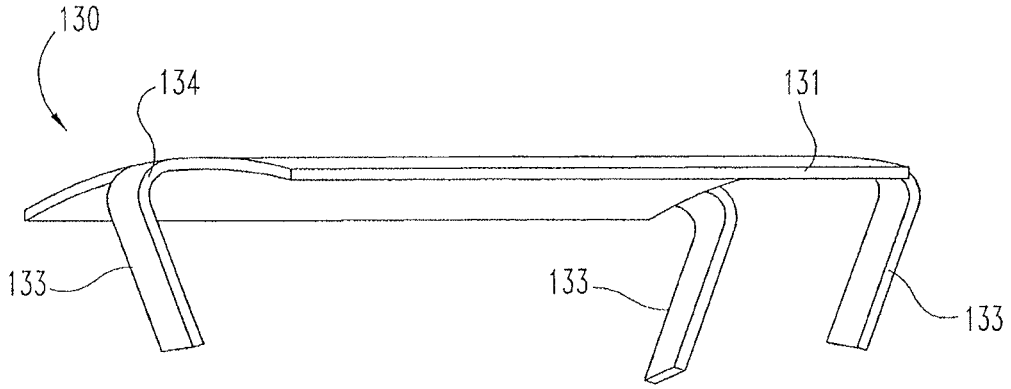
FIG. 2B is another perspective view of an embodiment of an intermediate component of the present application.

One non-limiting embodiment of load bearing intermediate component 130 is shown in FIGS. 2A and 2B. Load bearing intermediate component 130 of this embodiment has main body 131 that includes a relatively consistent texture and thickness with a somewhat curved profile. In other embodiments, main body 131 can include various geometries such as, but not limited to, multi-points of curvature or varying points of curvature lengthwise and crosswise, variable thickness, various surface parameters, and combinations thereof, among other possible variations. The load bearing intermediate component 130 can be constructed of a material allowing main body 131 to conform to a desired shape when placed relative to gas turbine engine components. This desired shape can be preformed in a manufacturing and/or assembly operation, or can take a desired shape upon contact with a component of the gas turbine engine. For example, the main body 131, or for that matter any portion of the load bearing intermediate component 130, can be conformed to shape through a pressing operation.

Extending from main body 131 are the plurality of finger portions 133. Finger portions 133 can have various shapes, sizes, thickness, etc. and can vary in relative placement around the main body 131. Finger portions 133 can be structured to wrap around first gas turbine engine component 110 and discourage displacement, removal and the like from the load bearing intermediate component 130 in at least one of a possibility of directions. For example, if the component 130 can be removed via sliding action in multiple directions, and/or lifting action in multiple directions, then the finger portions 133 and/or the main body 131 can be used to discourage removal in at least one of these omni-removal directions. The finger portions 133 can be configured to be flexible such as to assist in either or both an installation or removal of the component 130 from the gas turbine engine component 110. Finger portions 133 of FIGS. 2A and 2B are shown in a flexed position with a curved portion 134, but not all embodiments of the component 130 need include the curved portion 134. In various embodiments, finger portions 133 can maintain a flexed position but can also return or at least partially return to an original position where the original position resulted from a manufacturing process, for example. Finger portions 133 are illustrated here in FIGS. 2A and 2B with straight parallel edges, uniform thickness, width and length, and generally squared corners. Each of these and other such parameters can also take on other forms in various other embodiments.

In the embodiment illustrated in FIG. 2A, a first finger portion 135 is positioned on one side of the main body 131, and is on an opposite side of the main body 131 from two other second finger portions 136. Other embodiments can include other finger configurations. FIGS. 3A-3D demonstrate a few examples of various configurations where finger portions 133 are shown relatively in plane with main body 131 and not in an upturned position such as those depicted in various illustrated embodiments which include a curved portion between an end of the finger portion 133 and the main body 131. The curved portion can be characterized by a smooth curve, piecewise linear, and combinations thereof, among other possibilities. The curve can be formed from a bending operation that is sometimes characterized by yielding of material; it can be formed from other operations that do not result in yielding, such as but not limited to casting, etc. In addition, the curved portion can be located at any position, such as an intermediate position between the main body 131 and finger portion 133, near a transition between embodiments of the main body 131 and finger portion 133, etc. These figures can represent configurations for embodiments of intermediate component 130 prior to installation with the first gas turbine engine component 110.

Figure 3A:
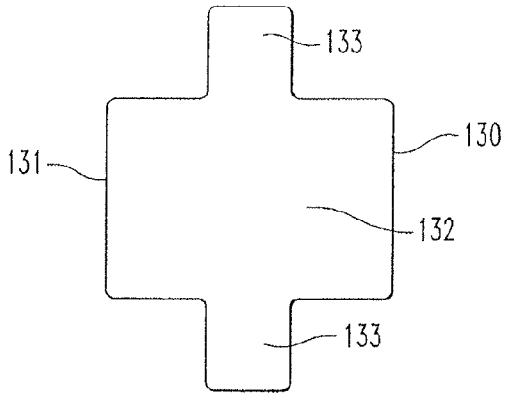
FIGS. 3A-D are representations of various shapes of an intermediate component.

FIG. 3A shows two finger portions 133 having rectangular-like outlines and are somewhat parallel with one another across main body 131. As in any of the embodiments disclosed herein, the finger portions 133 can have any variety of other configurations as they protrude from the main body 131.

Figure 3B:
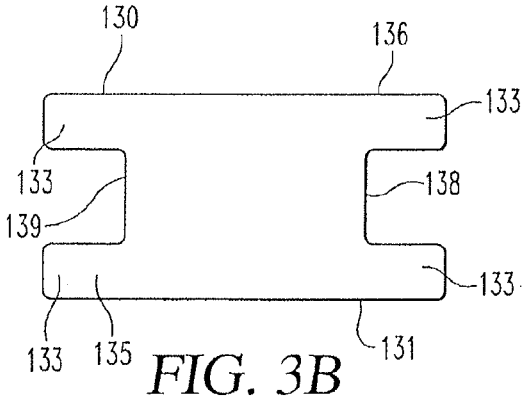

FIG. 3B illustrates a configuration for an embodiment having four finger portions 133. Positioned on a first side 139 of main body 131 are two first finger portions 135. Positioned on an opposing side 138 of main body 131 are two second finger portions 136. While first finger portions 135 and second finger portions 136 appear equally spaced, it should be noted that the spacing as well as the length and outline can be similar or vary amongst finger portions of a single embodiment or amongst various embodiments.

Figure 3C:
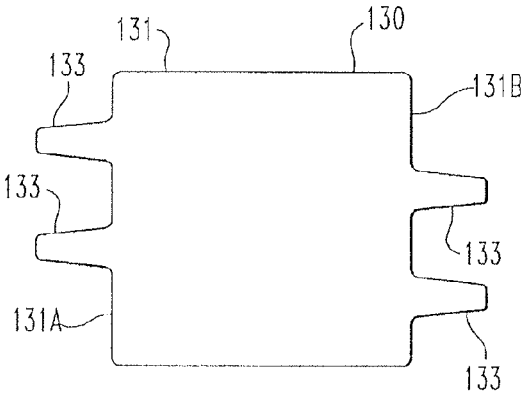

FIG. 3C demonstrates one embodiment of intermediate component 130 having finger portions 133 with non-uniform outlines which are positioned at varying intervals along opposing sides 131A, 131B of main body 131.

Figure 3D:
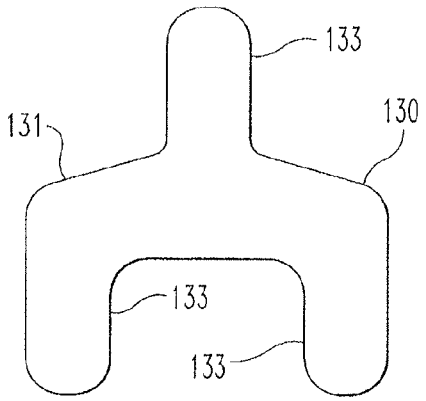

FIG. 3D shows another embodiment of an intermediate component 130 having an uneven number of finger portions 133 on opposing sides of main body 131. In this embodiment, finger portions 133 are shown with somewhat rounded outline. Further, main body 131 is shown with a non-uniform configuration.

Intermediate component 130 can have various configurations and be made from various materials such as but not limited to composites, plastics and metals. In a specific embodiment, intermediate component 130 can be made of a sheet metal. The sheet metal can be selected to allow intermediate component 130 to operate as a sacrificial compliant member upon repeated loading events.

Figure 4A:
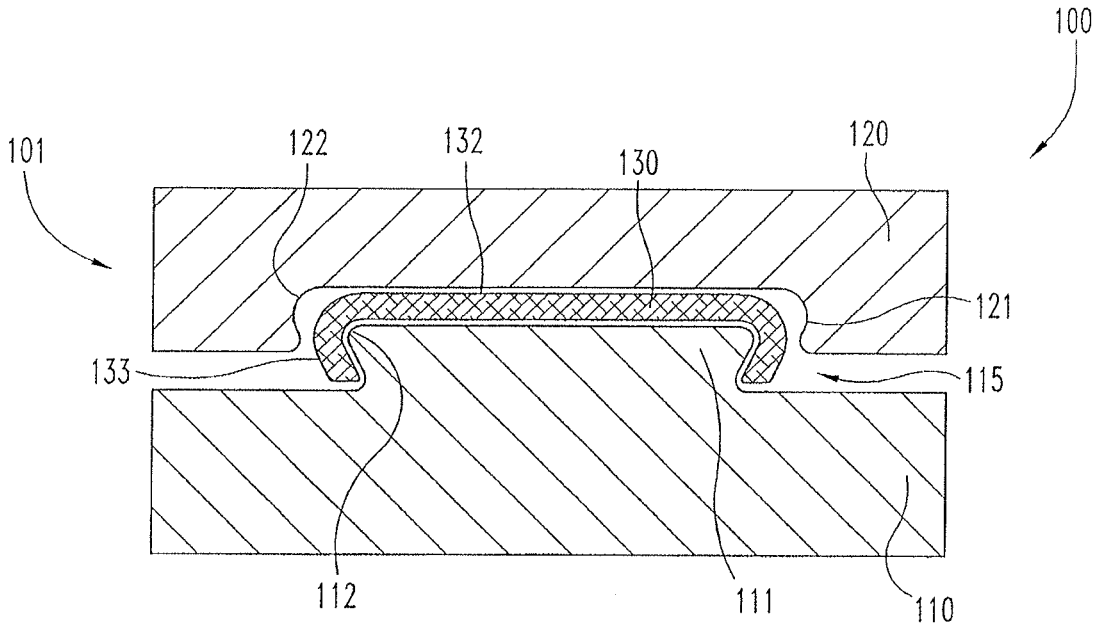
FIG. 4A is a cross sectional view of one embodiment showing a first component, a second component and an intermediate component.
Figure 4B:
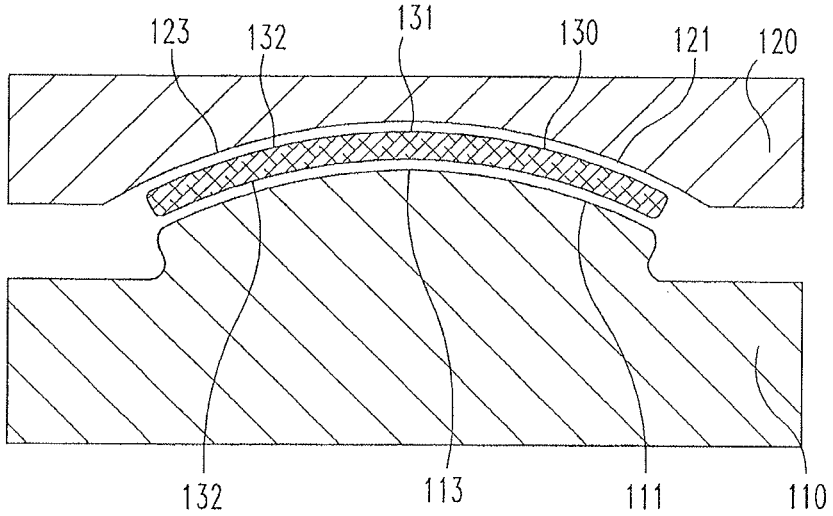
FIG. 4B is a cross sectional view of the embodiment of FIG. 4A from a different direction showing a first component, a second component and an intermediate component.

FIGS. 4A and 4B are cross sections of embodiments of a portion of gas turbine engine 100 including first gas turbine engine component 110, a second gas turbine engine component 120, and intermediate component 130. FIG. 4A represents a view from one direction of the assembly, and FIG. 4B represents a view from another direction. Of note in these figures is that the intermediate component 130 can have a relatively planar main body when its cross section is viewed from one direction, but relatively curved main body when its cross section is viewed from another direction. Intermediate component 130 is positioned between first gas turbine engine component 110 and second gas turbine engine component 120. First gas turbine engine component 110 is shown with first mating portion 111 including surface 113.

Second gas turbine engine component 120 is shown including a second mating portion 121 which can include various geometries. In one embodiment, second mating portion 121 can include part of an interlocking feature where second mating portion 121 is formed to receive first mating portion 111 to interlockingly secure first gas turbine engine component 110 during operation of gas turbine engine 100. Second mating portion includes a surface 122 which can have various profiles including an arcuate surface, a substantially planar surface, a textured surface, combinations thereof, and the like. The second gas turbine engine component 120 can be made with a material having a second coefficient of thermal expansion different from the first coefficient of thermal expansion for first gas turbine engine component 110. Part of the surface 122 is positioned opposite surface 113 of the first component 110 and in some forms the surface 122 includes a different shape than the shape of the surface 113. Thus, owing to differences in thermal expansion between the first component 110 and second component 130, the differences in shapes will likely change a loading distribution between the components 110 and 120. The intermediate component 130 can be used to bear the loading distribution as a result of a thermal induced change in configuration.

In the embodiment illustrated in FIG. 4A, intermediate component 130 is positioned at an interface 115 between first gas turbine engine component 110 and second gas turbine engine component 120. The main body 131 of intermediate component 130 can be configured to conform to first gas turbine engine component 110 and second gas turbine engine component 120 when first gas turbine engine component 110 is engaged with second gas turbine engine component 120 to form a coupled structure 101. The main body 131 can be captured on either first mating portion 111 of first gas turbine engine component 110 or second mating portion 121 of second gas turbine engine component 120 through a plurality of finger portions 133 extending from main body 131. Finger portions 133 can also be structured to define a load path through which load is transferred through the intermediate component 130 from first gas turbine component 110 to second gas turbine engine component 120.

In other additional and/or alternative embodiments that can be applicable to any of the configurations illustrated or discussed herein, first gas turbine engine component 110 is a ceramic matrix composite and second gas turbine engine component 120 is a component constructed of a different material. Such a different material can have a different coefficient of thermal expansion. Intermediate component 130 at interface 115 can be structured to bear at least a portion of load created and/or transferred between first gas turbine engine component 110 and second gas turbine engine component 120 during operation or repeated operations of the gas turbine engine. In various embodiments, loads can be present as the result of a dimensional mismatch between first mating portion 111 of first gas turbine engine component 110 and second mating portion 121 of second gas turbine engine component 120 which can be by design, due to manufacturing tolerances, due to operation of the gas turbine engine, among other possibilities. In other embodiments, load can be transferred as component dimensions vary during operation due to a mismatch in coefficient of thermal expansion, operating temperatures, and the like as discussed above. To set forth just one non-limiting example, if the components 110 and 120 include complementary curves that are well matched at a first temperature, a change in temperature can cause one curve to flatten out relative to the other curve. Such a change in orientation can lead to more concentrated loading, or even point loading, as the relative geometry changes. Some embodiments of the intermediate component 130 therefore can include primarily the main body 131 which can be used to accommodate the concentrated loading, but other forms will incorporate the finger portions 133 to accommodate the concentrated loading.

Returning to FIG. 4A, portion 132 of intermediate component 130 is shown. Portion 132 can have various profiles. In one embodiment, the profile of portion 132 can follow the profile of either first gas turbine engine component 110 or second gas turbine engine component 120 or both. In one specific embodiment, portion 132 of main body 131 is curved to be positioned between the arcuate surfaces of first mating portion 111 of first gas turbine engine component 110 and second mating portion 121 of second gas turbine engine component 120. In another embodiment, the profile of portion 132 of load bearing intermediate component 130 can include interference with either first gas turbine engine component 110 or second gas turbine engine component 120 or both to control load transfer points, for example.

FIG. 4B is a cross section from a different direction of the embodiment shown in FIG. 4A and illustrates the curved profile of intermediate component 130 for one embodiment. In the embodiment, portion 132 of main body 131 of intermediate component 130 is curved and curved portion 132 of main body 131 bears a loading imparted by contact with a first arcuate portion 113 of first mating portion 111 of first gas turbine engine component 110 and a second arcuate portion 123 of second mating portion 121 of second gas turbine engine component 120. While intermediate component 130 is shown as essentially level in the cross sectional view of FIG. 4A, it should be noted that intermediate component 130 can have multiple points of curvature and can follow the curvature of first mating portion 111, second mating portion 121 or both. Intermediate component 130 can also vary in thickness through either or both cross sections.

Figure 5A:
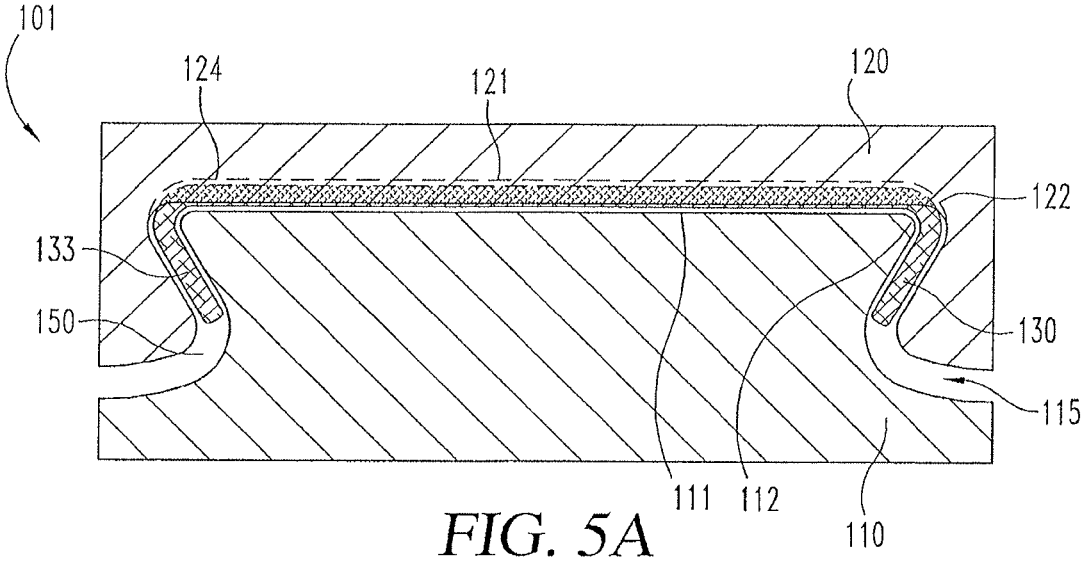
FIG. 5A is a cross sectional view of an embodiment showing a first component, a second component and an intermediate component.
Figure 5B:
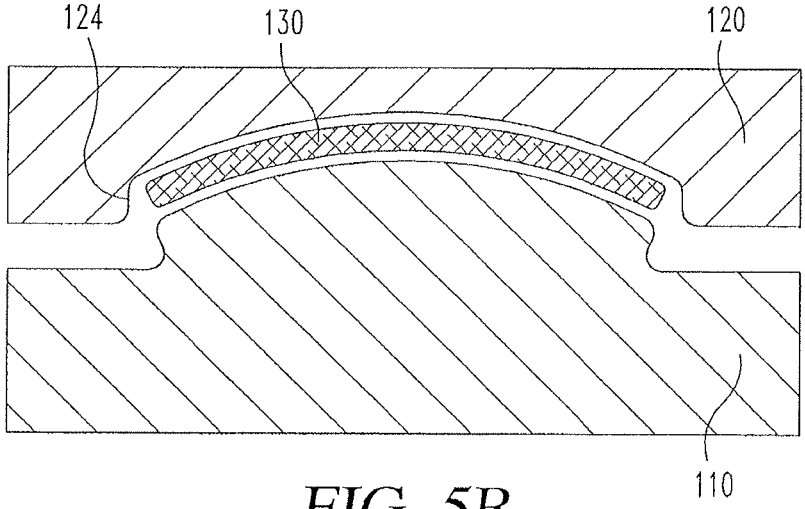
FIG. 5B is a cross sectional view of the embodiment of FIG. 5A from a different direction showing a first component, a second component and an intermediate component.

FIGS. 5A and 5B illustrate another embodiment of a portion of gas turbine engine 100 and depict views similar to those above with regard to FIGS. 4A and 4B. First gas turbine engine component 110 and second gas turbine engine component 120 are positioned relative to one another with first mating portion 111 and second mating portion 121 as a coupled structure 101. Intermediate component 130 is positioned at interface 115 between first gas turbine engine component 110 and second gas turbine engine component 120. Second gas turbine engine component 120 includes a recess portion 124 to allow intermediate component 130 to be positioned within recess portion 124. This embodiment also illustrates a configuration that provides for a cooling gas path 150 allowing passage of cooling air between first gas turbine engine component 110 and second gas turbine engine component 120. Though the recess portion 124 is shown relative to just one of the components 110 and 120, other embodiments can include recess portions in the other of the components, while in still further embodiments recesses can be included in both components.

Figure 6A:
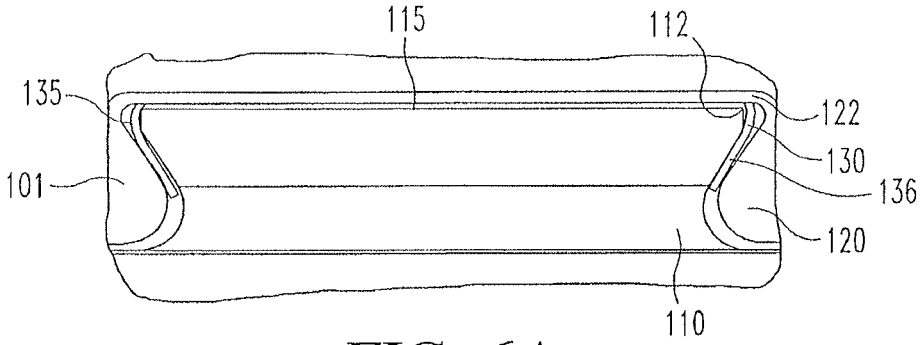
FIG. 6A is a cross sectional view of an embodiment showing a first component, a second component and an intermediate component.
Figure 6B:
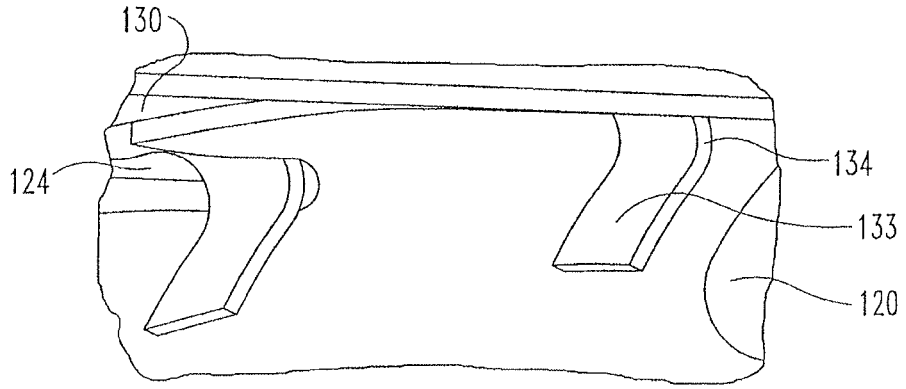
FIG. 6B is a perspective view of the embodiment of FIG. 6A showing a second component and an intermediate component.

Coupled structure 101 of FIGS. 6A and 6B can be assembled by orienting intermediate component 130 in a position relative to one or both first gas turbine engine component 110 and second gas turbine engine component 120. As in various of the embodiments above, the intermediate component 130 can be a sacrificial compliant member. Either of the first gas turbine engine components can be a composite component, such as a CMC component, while the other component can take on a different material type. The position would place intermediate component 130 at interface 115 between first gas turbine engine component 110 and second gas turbine engine component 120 when first gas turbine engine component 110 and second gas turbine engine component 120 are coupled together.

The intermediate component 130 can be manufactured as a device prior to being coupled to either one of the components 110 or 120, where the components are then subsequently fastened after the installation of the intermediate component 110. In some applications the intermediate component 110 can be inserted between the components 110 and 120 after the components 110 and 120 have been fastened together, such as through a sliding action. Though the intermediate component can be manufactured (cast, stamped, cut, etc.) prior to installation, various post engagement operations can also be performed to finish the installation process. For example, in some embodiments wherein the component includes fingers, the fingers can be turned into place over the component 110 or 120 to which it is associated/fastened. Such a turning can be the result of a bending action, for example.

Figure 7:
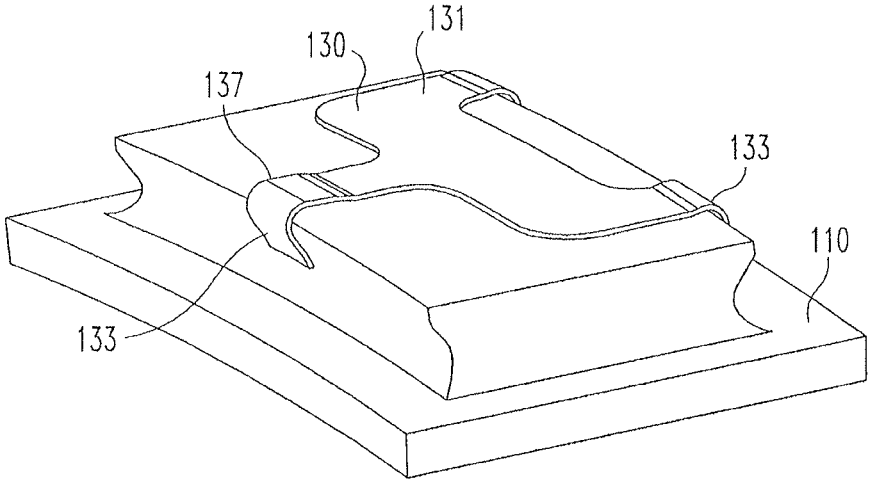
FIG. 7 is a perspective view of an embodiment of a component interfacing with an intermediate component.

FIG. 7 shows another embodiment of intermediate component 130 interfacing with first gas turbine engine component 110. Intermediate component 130 includes main body 131 with finger portions 133 extending from main body 131. A shape 137 or joggle feature is shown as part of finger portion 133 approximate main body 131. Other locations of the shape 137 are also contemplated herein. To set forth just one non-limiting example, in some forms the shape 137 can be formed in the main body 131 in lieu of being formed in the finger portion 133. Shape 137 can be designed to accommodate a seal (not shown). In one embodiment, the seal can be place between intermediate component 130 and first gas turbine engine component 110 or in another embodiment between second gas turbine engine component 120. In various embodiments, various seal profiles can include circular, D-ring, multi-sided, and the like. The position of the seal can vary along finger portion 133 and even in relation to main body 131.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a first gas turbine engine component structured for use in a gas turbine engine and having a first mating portion;

a second gas turbine engine component having a second mating portion formed to receive within it the first mating portion of the first component to interlockingly secure the first component for use during operation of the gas turbine engine; and a load bearing intermediate component positioned between the first mating portion of the first component and the second mating portion of the second component, the load bearing intermediate component including:

a main body having a portion configured to bear a loading imparted by contact between the first mating portion and the second mating portion, the main body captured on one of the first mating portion and the second mating portion through a plurality of finger portions extending from the main body, wherein the plurality of finger portions each contact the second mating portion of the second gas turbine engine component at a different location and the plurality of finger portions includes a first finger portion that contacts the second component at a first location, a second finger portion that contacts the second component at a second location spaced from the first location in a circumferential direction, and a third finger portion that contacts the second component at a third location spaced discreetly from the first location in both the circumferential direction and an axial direction.

2. The apparatus of claim 1, wherein the first gas turbine engine component has a different coefficient of thermal expansion than a coefficient of thermal expansion of the second gas turbine engine component.

3. The apparatus of claim 2, wherein the first gas turbine engine component is a ceramic matrix composite, wherein the portion of the main body is curved, and wherein the curved portion of the main body bears a loading imparted by contact between an arcuate portion of the first mating portion and an arcuate portion of the second mating portion.

4. The apparatus of claim 3, wherein the load bearing intermediate component is made of sheet metal.

5. The apparatus of claim 2, wherein one of the plurality of finger portions includes a shape that permits a seal to be located between the one of the plurality of finger portions and the first gas turbine engine component.

6. The apparatus of claim 2, wherein the second gas turbine engine component includes a recess into which the load bearing intermediate component is situated.

7. The apparatus of claim 1, wherein the load bearing intermediate component positioned between the first mating portion of the first component and the second mating portion of the second component defines a load path between the first component and the second component.

8. An apparatus comprising:

a gas turbine engine construction that includes a first component having a first curved portion that includes a first coefficient of thermal expansion, a second component having a second curved portion that includes a second coefficient of thermal expansion different from the first coefficient of thermal expansion, and an intermediate component independent of the first component and second component and located between the first curved portion and second curved portion, the intermediate component structured to take up bearing loads between the first component and the second component when a temperature of the gas turbine engine construction changes resulting in a change in relative orientation of the first curved portion and second curved portion, wherein the intermediate component includes a main body and a first finger portion that extends from the main body, a second finger portion that extends from the main body and spaced from the first finger portion in a circumferential direction, and a third finger portion that extends from the main body and is spaced from the first finger portion in both circumferential and axial directions, and wherein the first finger portion, the second finger portion, and the third finger portion engage the second component to block movement of the second component relative to the first component in a radial direction.

9. The apparatus of claim 8, wherein the first finger portion, the second finger portion, and the third finger portion of the intermediate component wrap around the first component to discourage removal of the intermediate component from the first component and wherein the first component is a composite construction.

10. The apparatus of claim 9, wherein the intermediate component is one of a metal, a composite, or a plastic material.

11. The apparatus of claim 9, wherein the second component includes a recess into which the intermediate component is located.

12. The apparatus of claim 8, wherein the intermediate component includes a configuration that provides for passage of cooling air between the first component and the second component.

13. The apparatus of claim 8, wherein a thickness of the intermediate component varies along a dimension of the intermediate component.

14. A method comprising:

orienting a compliant member in a location relative to a ceramic matrix composite component that would be at an interface between the ceramic matrix composite component and a gas turbine engine load path component when the components are coupled together;

positioning an extension of the compliant member around a curved feature of one of the ceramic matrix composite component and the gas turbine engine load path component; and engaging the ceramic matrix composite component with the gas turbine engine load path component to form a coupled structure that includes the compliant member disposed therebetween, wherein the compliant member includes a main body and a first finger portion that extends from the main body, a second finger portion that extends from the main body and is spaced from the first finger portion in a circumferential direction, and a third finger portion that extends from the main body and is spaced from the first finger portion in both circumferential and axial directions, and wherein the first finger portion, the second finger portion, and the third finger portion engage one of the ceramic matrix composite component and the gas turbine load path component to block movement of the one of the ceramic matrix composite component and the gas turbine load path component relative to the other of the ceramic matrix composite component and the gas turbine load path component in a radial direction.

15. The method of claim 14, which further includes positioning the compliant member in a recess of one of the ceramic matrix composite component and the gas turbine engine load path component, and wherein the recess is located within the gas turbine engine load path component, and which further includes providing a cooling gas path as a result of the engaging.

16. The method of claim 14, wherein the positioning includes positioning the first finger portion, the second finger portion, and the third finger portion of the compliant member around a plurality of curved portions of one of the ceramic matrix composite component and the gas turbine engine load path component.

17. The method of claim 16, wherein the compliant member includes a shape that permits a seal to be positioned between it and one of the ceramic matrix composite component and the gas turbine engine load path component.

18. The method of claim 16, wherein the compliant member includes a shape having a non-constant thickness along a dimension of the sacrificial compliant member.

* * * * *